US009719322B2

(12) United States Patent
Goebel

(10) Patent No.: US 9,719,322 B2
(45) Date of Patent: Aug. 1, 2017

(54) LANDING COLLAR, DOWNHOLE SYSTEM HAVING LANDING COLLAR, AND METHOD

(71) Applicant: Baker Hughes Incorporated, Houston, TX (US)

(72) Inventor: Kevin M. Goebel, Casper, WY (US)

(73) Assignee: BAKER HUGHES INCORPORATED, Houston, TX (US)

( * ) Notice: Subject to any disclaimer, the term of this patent is extended or adjusted under 35 U.S.C. 154(b) by 371 days.

(21) Appl. No.: 14/329,159

(22) Filed: Jul. 11, 2014

(65) Prior Publication Data

US 2016/0010400 A1 Jan. 14, 2016

(51) Int. Cl.

| | |
|---|---|
| ***E21B 33/16*** | (2006.01) |
| ***E21B 23/04*** | (2006.01) |
| ***E21B 43/10*** | (2006.01) |

(52) U.S. Cl.

CPC ..... *E21B 33/16* (2013.01); *E21B 23/04* (2013.01); *E21B 43/10* (2013.01)

(58) Field of Classification Search

CPC ..... E21B 17/08; E21B 19/06; E21B 33/12; E21B 33/16; E21B 43/10; E21B 23/04; E21B 43/106

See application file for complete search history.

(56) References Cited

U.S. PATENT DOCUMENTS 6,082,541 A * 7/2000 Bewick ..... B65D 7/04 206/508

2014/0102723 A1* 4/2014 Stair ..... E21B 23/08 166/386

OTHER PUBLICATIONS

Baker Hughes Incorporated; "Type I Landing Collar, Type II Landing Color, Pump Down Plug, Wiper Plug, Float Collar and Liner Hanger"; Liner Hanger Catalog; (2010) p. 73, p. 79, p. 32.

Baker Hughes; Plug Systems; "Minimize cementing risks with industry's widest plug section"; (2016); Retrieved from Internet http://www.bakerhughes.com/products-and-services/completions/wellbore-construction/liner-solutions/plug-systems; 1page.

* cited by examiner

*Primary Examiner* — Yong-Suk (Philip) Ro

(74) *Attorney, Agent, or Firm* — Cantor Colburn LLP

(57) ABSTRACT

A landing collar includes a tubular body having a longitudinally extending main flow path; and, a shearable liner wiper plug landing seat installed within the body and configured to receive a liner wiper plug in an unsheared condition of the landing seat. The landing seat movable in a downhole direction within the body in a sheared condition of the landing seat. The landing seat including at least one radial fluid communication passageway through a wall of the landing seat; wherein, in the sheared condition of the landing seat. The fluid communication passageway of the landing seat is in fluid communication with a fluid communication path between the tubular body and the landing seat. A method of completing a cemented liner with a wet shoe.

22 Claims, 5 Drawing Sheets

LANDING COLLAR, DOWNHOLE SYSTEM HAVING LANDING COLLAR, AND METHOD

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration.

When a liner is run through casing in the borehole, the liner is supported within the casing by a liner hanger. Hydraulically set liner hangers have been developed that deploy slips radially outwardly when internal pressure is built up on a dropped ball. The internal pressure acts against a bias force on each slip toward the retracted position. The hanger is set when internal pressure is applied to the liner hanger's cylinder which extends the slips against the casing. When coupled with set down weight on the mandrel, the weight of the liner is then supported by the extended slips that bite against the surrounding casing.

Cement is used to seal tubulars, such as the liner, in the borehole and prevent fluid and gas migration. The cement is pumped through a one way valve, such as a float collar or float shoe, at the lower end of the string to be sealed. Float collars and float shoes prevent heavier uncured cement in the annulus from u-tubing back into the liner when displacement is complete. The pumped cement needs to be displaced from the tubular to the surrounding annulus after it is delivered from the surface. Different wiper plug systems have been devised to push the cement ahead of the plug until the plug is bumped on a landing shoulder in the vicinity of the shoe.

Liner wiper plugs are typically suspended at the top of a liner to be cemented with an open passage through the wiper plug through which the cement is delivered. A dart is then landed in the wiper plug and the two travel together to wipe the liner free of cement until the plug is bumped. The plug can have extending fins in parallel rows or it can be a solid block. One or two plug systems can be used and in each case a dart lands in the plug to move the two in tandem. Composite materials have been employed in such plugs to speed up milling that occurs after the plug or plugs are bumped and the cement sets. The normal procedure is to drill out the plug or plugs and the shoe and either extend the well or complete the well.

Usually run in the liner one or two joints above a float collar or shoe, one type of landing collar provides the seat and latch profile to catch the liner wiper plug at the completion of cement displacement. Landing collars and plugs are designed to ensure rapid and complete drillout. Another type of landing collar has all of the features of the first type of landing collar, and also includes an integral ball seat below the liner wiper plug seat. When a setting ball is dropped and seated, pressure may be applied to activate hydraulic devices in the liner string, such as hydraulic-set liner hangers and external casing packers. Further increase in pressure shears out the ball and seat, restoring full circulation through the shoe for cementing operations.

The art would be receptive to alternative devices and methods for landing collars to provide variety and improvement in cementing operations.

BRIEF DESCRIPTION

A landing collar includes a tubular body having a longitudinally extending main flow path; and, a shearable liner wiper plug landing seat installed within the body and configured to receive a liner wiper plug in an unsheared condition of the landing seat, the landing seat movable in a downhole direction within the body in a sheared condition of the landing seat, the landing seat including at least one radial fluid communication passageway through a wall of the landing seat; wherein, in the sheared condition of the landing seat, the fluid communication passageway of the landing seat is in fluid communication with a fluid communication path between the tubular body and the landing seat.

A method of completing a cemented liner with a wet shoe, the method including landing a liner wiper plug in a shearable liner wiper plug landing seat in a body of a landing collar; increasing pressure within the landing collar to shear the landing seat; and, establishing fluid communication from uphole the landing seat to downhole the landing seat via a fluid communication path between the landing seat and the body.

A landing collar includes a tubular body having a longitudinally extending main flow path; a ball seat assembly having a shearable ball seat installed within the body; and, a shearable liner wiper plug landing seat installed within the body uphole of the ball seat assembly, the landing seat configured to receive a liner wiper plug in an unsheared condition of the landing seat, the landing seat movable in a downhole direction within the body in a sheared condition of the landing seat.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
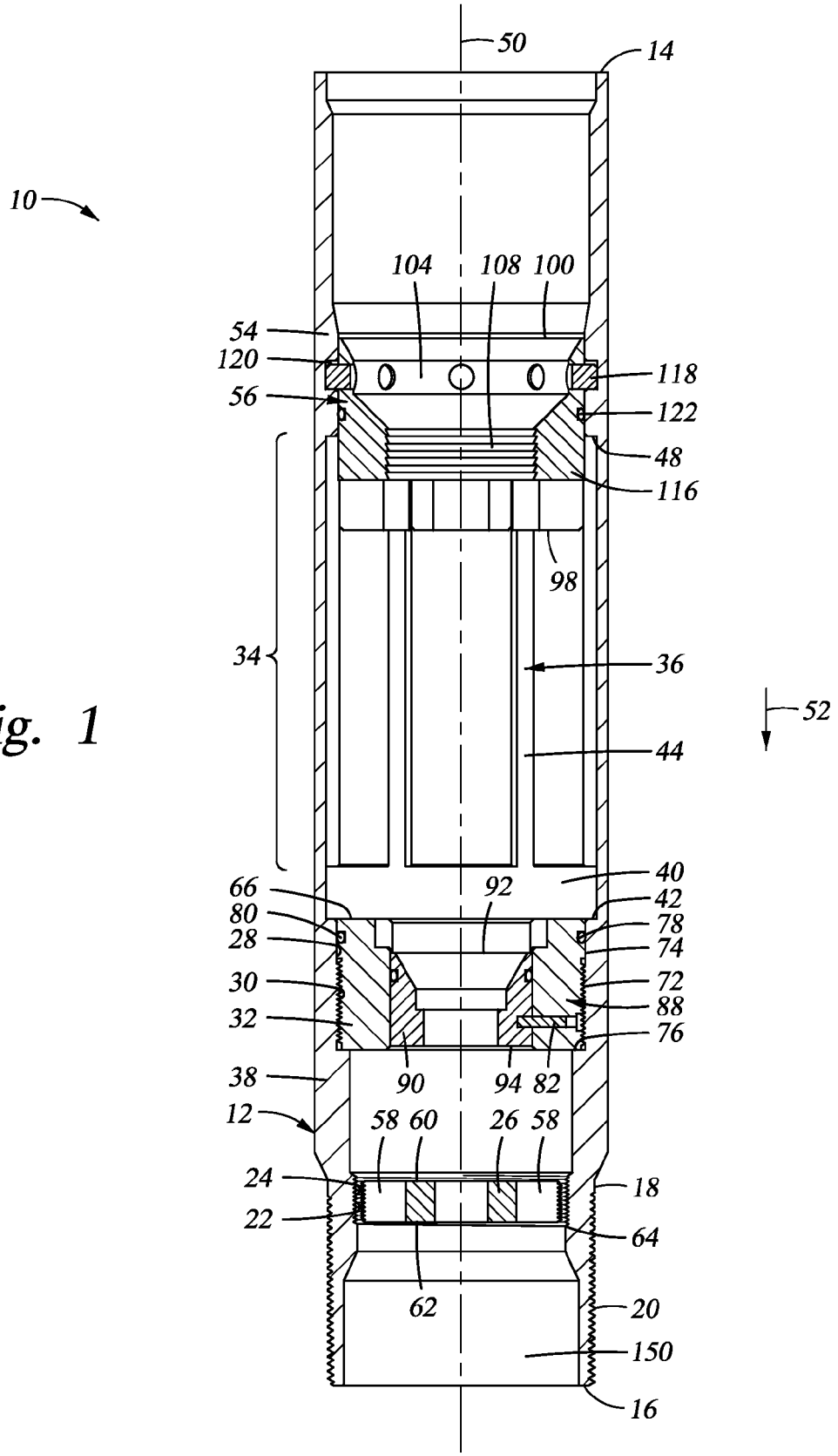
FIG. 1 depicts a side exposed view of an exemplary embodiment of a landing collar.
Figure 2:
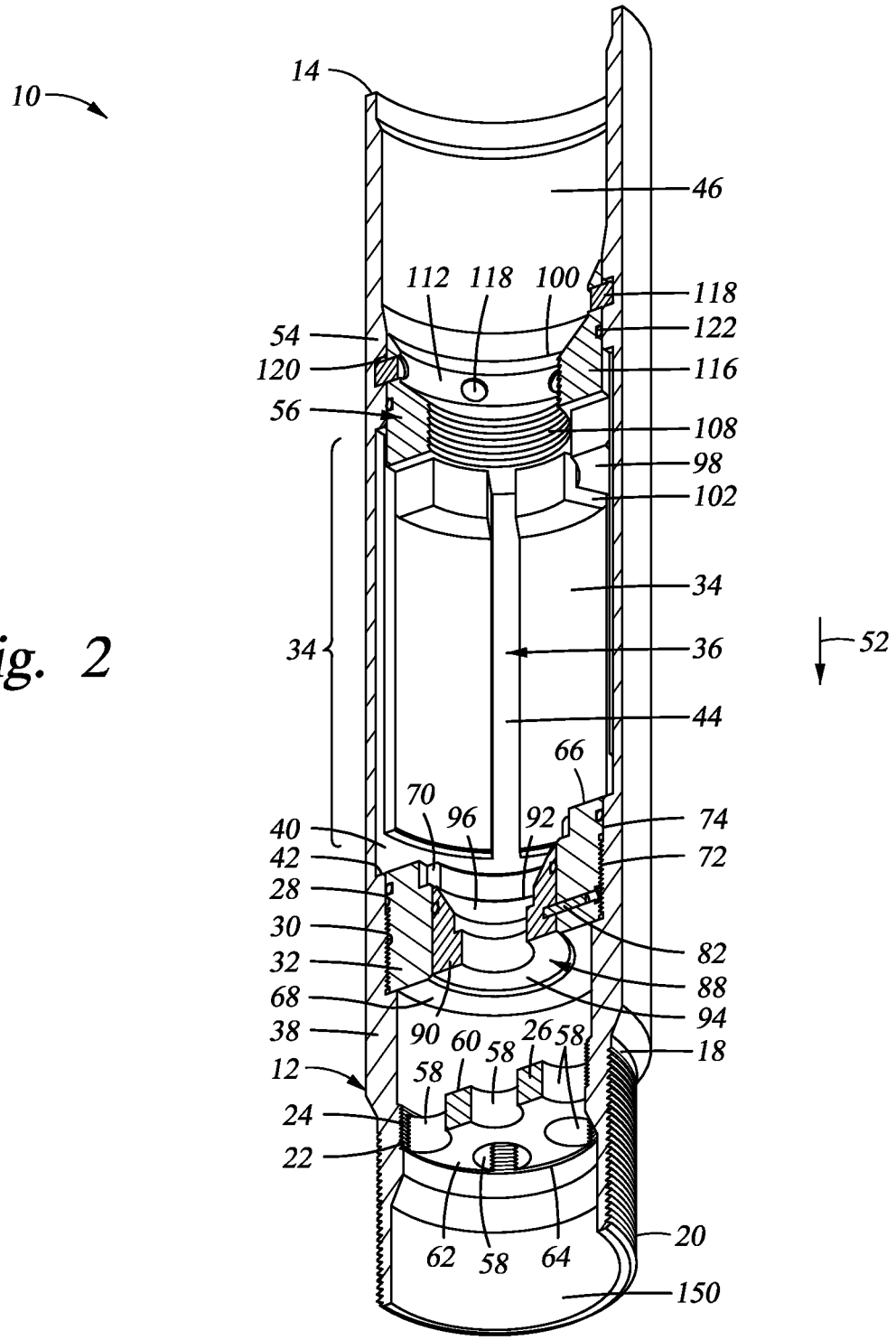
FIG. 2 depicts a cross-sectional perspective view of the landing collar of FIG. 1.
Figure 3:
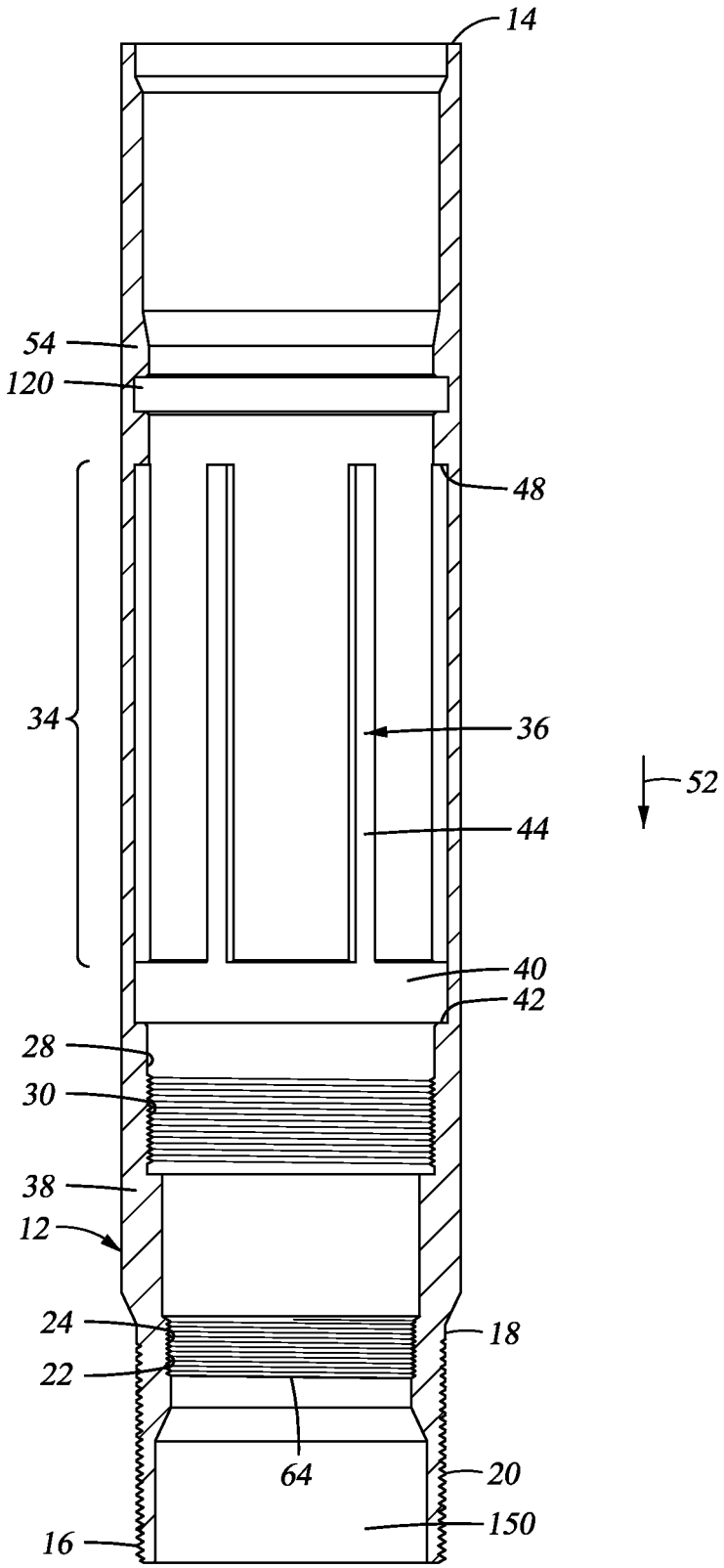
FIG. 3 depicts a side exposed view of an exemplary landing collar body for the landing collar of FIGS. 1 and 2.

An exemplary embodiment of an assembled landing collar 10 is shown in FIGS. 1 and 2. The landing collar 10 includes a landing collar housing or body 12, as further shown in FIG. 3. The landing collar body 12 is generally tubular and surrounds a main flow path 150, for the purpose of passing cement and fluid in a downhole direction 52, and the landing collar body 12 includes an uphole end 14 and a downhole end 16. The external surface 18 adjacent the downhole end 16 may include external threads 20 for connection with additional sections of liner string and joints, which in turn may be connected to a float collar 130 or shoe 132 (FIG. 5). While external threads are illustrated for connecting the landing collar body 12 to other downhole components, alternative connection methods may be incorporated. Within the landing collar body 12, a first interior threaded portion 22 of the landing collar body 12 includes first internal/female threads 24 for receiving a baffle 26 therein, and a second interior threaded portion 28 of the landing collar body 12 includes second internal/female threads 30 for threadably receiving a ball seat insert 32 therein. The inner diameter of the first interior threaded portion 22 is smaller than the inner diameter of the second interior threaded portion 28. The first interior threaded portion 22 may be spaced a longitudinal distance from the downhole end 16, and the second interior threaded portion 28 may be spaced a longitudinal distance from the first interior threaded portion 22. Uphole of the second interior threaded portion 28 is a flow channel section 34 having a flow channel pattern 36 radially indented into a wall 38 of the landing collar body 12. By "radially indented" it should be understood that a radius of the body 12 at a location of the flow channel pattern 36 is greater than a radius of the body 12 at other inner peripheral locations of the flow channel section 34. In the illustrated embodiment, the flow channel pattern 36 includes a ring-shaped portion 40 uphole and longitudinally spaced from the second interior threaded portion 28 at a downhole end 42 of the flow channel section 34. Because the flow channel pattern 36 is radially indented into the wall 38 of the body 12, an inner diameter at the ring-shaped portion 40 is greater than an inner diameter at the second interior threaded portion 28. The flow channel pattern 36 further includes at least one flow channel 44 longitudinally extending from the ring-shaped portion 40 and indented into the wall 38 of the landing collar body 12 from an interior 46 of the landing collar body 12. The at least one flow channel 44 extends from an uphole end 48 of the flow channel section 34 towards the ring-shaped portion 40, and as illustrated, the flow channel pattern 36 includes a plurality of such flow channels 44 extending in a direction substantially parallel to a longitudinal axis 50 of the landing collar body 12. The flow channels 44 are dispersed about the inner periphery of the flow channel section 34. In an alternative exemplary embodiment, the flow channels 44 may exhibit a helical pattern within the landing collar body 12, or other non-parallel pattern, as long as such flow channels 44 are still arranged from the uphole end 48 of the flow channel section 34 to the downhole end 42 (to ring shaped portion 40) of the flow channel section 34 to allow for fluid flow in a downhole direction 52, as will be further described below. Uphole of the flow channel section 34 within the landing collar body 12 is a liner wiper plug landing seat receiving area 54 for receiving a liner wiper plug landing seat 56, as further shown in FIG. 4.

The devices of the landing collar 10 housed by the landing collar body 12 will now be described in further detail. As further shown in FIGS. 1 and 2, the baffle 26 includes an external thread about its outer periphery, and a plurality of longitudinal apertures 58 extend from an uphole end 60 to a downhole end 62 of the baffle 26. The longitudinal apertures 58 allow the passage of fluid flow and cement therethrough. The baffle 26 is secured within the landing collar body 12 by the threads. When inserting the baffle 26 within the landing collar body 12, excessive threading of the baffle 26 into the landing collar body 12 may be prohibited by a shoulder or final thread 64 of the first interior threaded portion 22. Thus, the baffle 26 can be threaded into the landing collar body 12 until it no-goes, and the baffle 26 is securely mounted within the landing collar body 12.

The illustrated exemplary embodiment of the ball seat insert 32 includes an uphole end 66 and a downhole end 68. The uphole end 66 may include a notch 70 to allow for tightening within the landing collar body 12, and more particularly within the second interior threaded portion 28 via external/male threads 72 on an exterior surface 74 of the ball seat insert 32. The ball seat insert 32 is prevented from further movement in the downhole direction 52 by a shoulder 76 in the landing collar body 12 at a downhole end of the second interior threaded portion 28. The ball seat insert 32 may further include one or more circumferential grooves 78 on the exterior surface 74 of the ball seat insert 32, the circumferential grooves 78 sized to receive a respective number of sealing rings 80, such as O-rings, therein. The ball seat insert 32 may further include apertures or a groove for receiving shear screws or pins 82 with respect to the fixing of a shearable ball seat 90 installed within the ball seat insert 32.

The ball seat insert 32 includes an inner periphery sized for receiving the shearable ball seat 90 therein, and likewise the ball seat 90 includes an outer periphery sized to nest within the inner periphery of the ball seat insert 32. The ball seat 90 is installed into the ball seat insert 32, and fixed therein such as with the use of shear screws prior to threading the ball seat insert 32 into the landing collar body 12. The ball seat 90 includes a tubular shaped inner surface providing a longitudinal flow path for allowing the passage of fluid (and cement) therethrough. The uphole end 92 of the ball seat 90 includes a greater inner diameter than an inner diameter at a downhole end 94 of the ball seat 90. The shearable ball seat 90 includes a tapered ball receiving area 96, such as a frustoconical interior surface. In an exemplary embodiment, the shearable ball seat 90 has substantially the same longitudinal length as the ball seat insert 32, however some differences in longitudinal lengths may also be accommodated.

Figure 4:
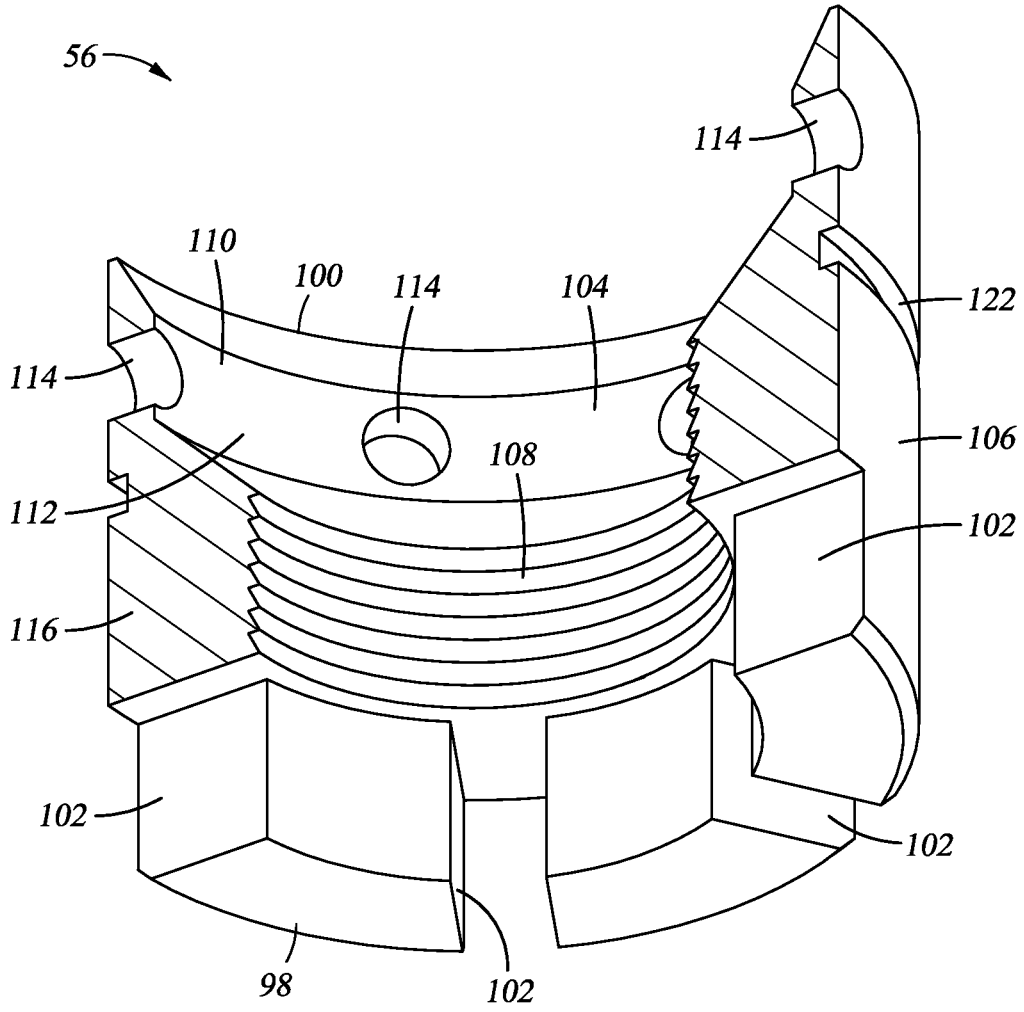
FIG. 4 depicts a cross-sectional perspective view of a landing seat for the landing collar of FIGS. 1 and 2; and, FIG. 5 depicts a schematic exploded view of an exemplary embodiment of a downhole system including the landing collar.
Figure 5:
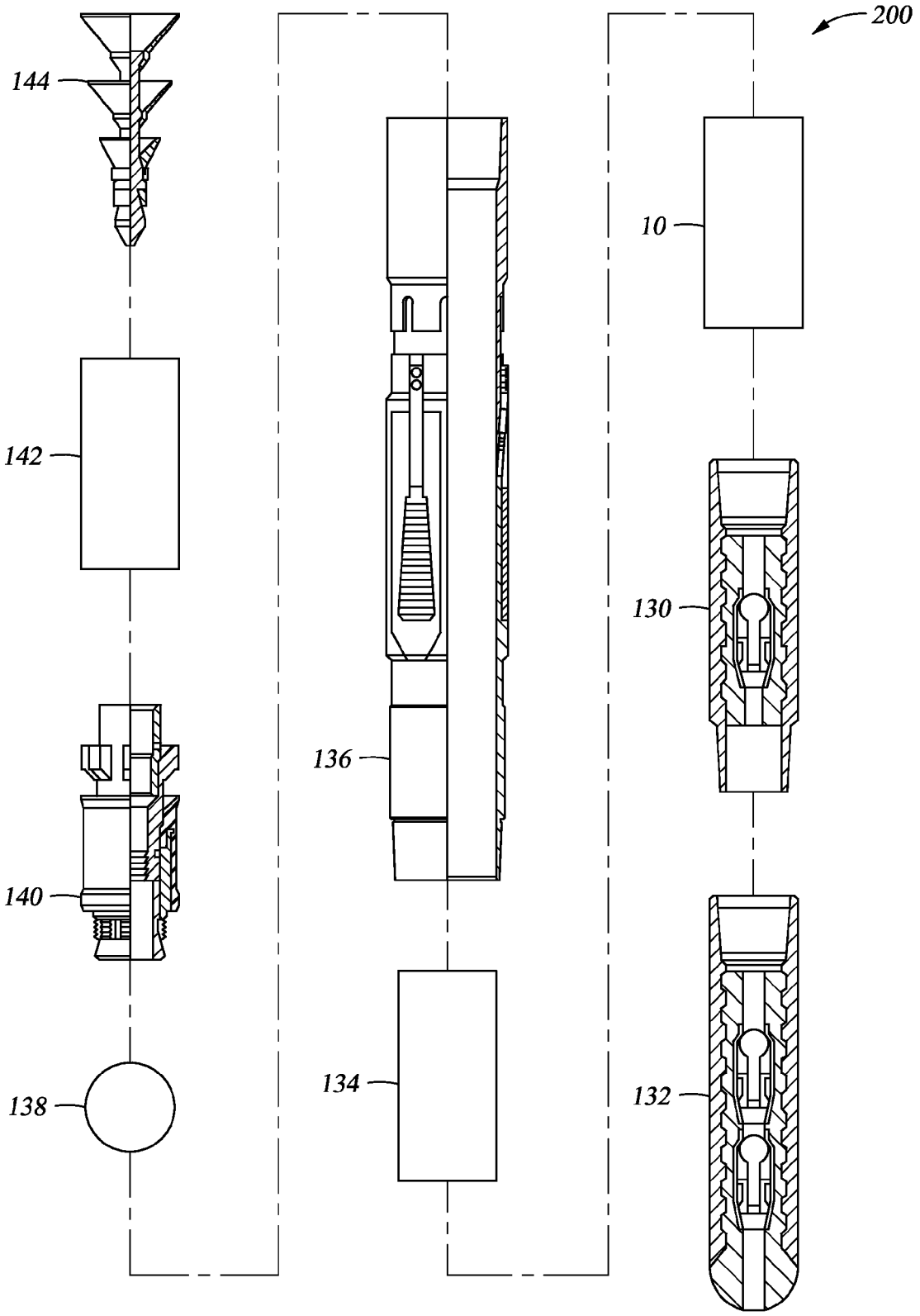

The liner wiper plug landing seat 56, as further shown in FIG. 4, includes a downhole end 98 and an uphole end 100. The downhole end 98 includes longitudinal notches 102 that radially extend from an interior surface 104 to an exterior surface 106 of the liner wiper plug landing seat 56. While the longitudinal notches 102 are depicted as extending from the downhole end 98 for greater flow-through, they may alternatively be shaped as radial apertures in the downhole portion of the landing seat 56. The longitudinal notches 102 serve as a fluid communication passageway through the wall 116 of the landing seat 56. Uphole of the longitudinal notches 102 are a plurality of internal ring-shaped grooves 108 sized for receiving external ring-shaped protrusions of a liner wiper plug 140 (FIG. 5). Uphole of the internal ring-shaped grooves 108 is a frustoconical section 110 having a smaller inner diameter at a downhole end of the frustoconical section 110 and a larger inner diameter at an uphole end of the frustoconical section 110. The particular profile of the interior surface 104 of the liner wiper plug landing seat 56 is determined based on the particular liner wiper plug intended to be landed within the liner wiper plug landing seat 56, and therefore the illustrated liner wiper plug landing seat 56 is exemplary in nature. Uphole of the frustoconical section 110 is a tubular section having a plurality of radial apertures 114 extending through a wall 116 of the liner wiper plug landing seat 56. The radial apertures 114 are sized to receive shear pins 118 or shear screws, which may be further received in a shear screw groove 120 of the landing collar body 12. The liner wiper plug landing seat 56 may be further tapered at the uphole end 100 for guiding the liner wiper plug therein. The exterior surface 106 of the liner wiper plug landing seat 56 may include one or more sealing ring grooves 122 for receiving a sealing ring therein. The liner wiper plug landing seat 56 is installed within the landing collar body 12 by installing the shear pins 118 (or screws) through the landing seat 56 and the shear screw groove 120.

The landing collar 10 described herein allows for the use of a shearable ball seat 90 and shearable landing seat 56. To assemble the landing collar 10, o-rings, if employed, are installed onto required components as needed. The baffle 26 is inserted into the landing collar body 12 through the uphole end 14 of the landing collar body 12. The baffle 26 is then threaded into the landing collar body 12 within the first interior threaded portion 22 of the landing collar body 12 until it no-goes. The shearable ball seat 90 is installed into the ball seat insert 32 with the use of shear screws or the like prior to threading the ball seat insert 32 into the landing collar body 12. The notch 70 cut in the uphole end 66 of the ball seat insert 32 allows for tightening of the ball seat assembly 88, which includes the ball seat 90 and ball seat insert 32, within the second interior threaded portion 28 of the landing collar body 12. The liner wiper plug landing seat 56 is subsequently installed inside the landing collar body 12 within the liner wiper plug landing seat receiving area 54 by installing shear pins 118 through the landing seat 56 and the shear screw groove 120 of the landing collar body 12.

With further respect to FIGS. 1 and 2, and additional reference to FIG. 5, a downhole system 200 incorporating the landing collar 10 is shown. It should be noted that exemplary devices within the downhole system 200 are not shown to scale relative to each other, but are depicted to demonstrate some features and an exemplary order of devices for a better understanding of the downhole system 200 usable within a borehole. Upon completion of the landing collar 10, the landing collar 10 may be made up uphole of a float collar 130 and float shoe 132, and a drill pipe or liner 134 with liner hanger 136 uphole of the landing collar 10. This combination or "string" of devices, with any number of additional sections of liner 134, can be run downhole, such as to bottom of a borehole. Once on bottom, a ball 138 is dropped to the ball seat 90 in the landing collar 10 and pressure is applied within the string to hydraulically set the liner hanger 136. Once the liner hanger 136 is confirmed to be hung, additional pressure is applied within the string to shear the ball seat 90 out of the ball seat insert 32 so that the ball 138 and seat 90 fall in a downhole direction 52 onto the baffle 26 located closer to the downhole end 16 of the landing collar 10. Once circulation is regained, the cement job is pumped. The cement flows through the liner wiper plug landing seat 56, the flow channel section 34, the ball seat insert 32, around the ball 138 and ball seat 90, and through the apertures 58 in the baffle 26. The liner wiper plug 140 may be shear pinned to the bottom of a running string, exemplified by 142. After the calculated volume of cement is pumped, the pump down plug 144 is dropped to wipe the string/drill pipe of cement. The pump down plug 144 and the liner wiper plug 140 latch together in the running tool and are pumped through the casing until they latch into the liner wiper plug landing seat 56 in the landing collar 10. A flow back check is performed to assure the plugs 140, 144 have latched and the floats (one way check valves in the float collar 130 and float shoe 132) are holding. At this point, fluid communication through the flow path 150 of the body 12 is blocked at the landing seat 56. Pressure is applied down the drill pipe/string, which acts on the liner wiper plug 140 within the liner wiper plug landing seat 56. The pressure on the liner wiper plug 140 then shears the shear pins 118 securing the liner wiper plug landing seat 56 to the landing collar body 12 such that the liner wiper plug 140 (and pump down plug 144) and liner wiper plug landing seat 56 are forced downhole until they bottom out on the uphole end 66 of the ball seat insert 32. The flow channels 44 of the flow channel pattern 36 are then exposed at least at an uphole end 48 of the flow channel section 34 so that circulation is regained. That is, flow of fluid can bypass the blocked liner wiper plug landing seat 56 via the flow channels 44. The longitudinal notches 102 in the liner wiper plug landing seat 56 allow fluid that has bypassed the liner wiper plug 140 and liner wiper plug landing seat 56 through the flow channels 44 to be redirected radially inward via the notches 102, and then downhole through the ball seat insert 32 and further in the downhole direction 52. Several barrels of completion fluid may then be pumped through the flow channel pattern 36 and beyond the sheared landing seat 56 to displace cement from the shoe track, thus allowing for a wet shoe. Completing a cemented liner with a wet shoe allows for a customer to pump guns and plugs down the well for a frac without first having to drill out the plugs.

While a particular flow pattern 36 has been illustrated and described, the landing collar 10 relies on the ability to re-establish fluid communication within a main flow path 150 from uphole to downhole of the liner wiper plug 140/pump down plug 144 and liner wiper plug landing seat 56. A longitudinal length of the flow channel section 34 is longer than a longitudinal length of the landing seat 56 so that the fluid communication can be established. An alternate embodiment may thus utilize a landing seat that shears out into a larger inner diameter of a landing collar body, with the larger inner diameter providing the flow channel to bypass the liner wiper plug and the liner wiper plug landing seat. Thus, the landing collar 10 may include any fluid communication path, such as the flow channel pattern 36 or otherwise, between the sheared liner wiper plug landing seat 56 and the landing collar body 12, and any radial fluid communication passageway in the landing collar body 12, such as the notch 102, to re-establish fluid communication with the main flow path 150 uphole and downhole of the landing seat 56 in the landing collar 10, such as for the purpose of pumping a wet shoe.

The landing collar 10 thus allows for a method of completing a cemented liner with a wet shoe. A setting ball 138 is dropped to ball seat 90 in the landing collar 10 to set the liner hanger 136 hydraulically. The ball seat 90 is sheared to regain circulation and pump the cement job. The liner 134 is wiped and the liner wiper plug 140 is landed in the landing collar 10. After flow back check is performed, pressure is increased to shear liner wiper plug landing seat 56 downhole to gain access to flow channels 44 past the liner wiper plug 140. This allows for the customer to pump a wet shoe.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Further-more, the use of the terms a, an, etc. do not denote a limitation of quantity, but rather denote the presence of at least one of the referenced item.

What is claimed:

1. A landing collar comprising:

a tubular body having a longitudinally extending main flow path; and, a shearable liner wiper plug landing seat installed within the body and configured to receive a liner wiper plug in an unsheared condition of the landing seat, the landing seat movable in a downhole direction within the body in a sheared condition of the landing seat, the landing seat including at least one radial fluid communication passageway through a wall of the landing seat;

wherein, in the sheared condition of the landing seat, the fluid communication passageway of the landing seat is in fluid communication with a fluid communication path between the tubular body and the landing seat.

2. The landing collar of claim 1, wherein the body includes a flow channel section having a flow channel pattern radially indented into the body, the flow channel pattern forming the fluid communication path.

3. The landing collar of claim 2, wherein the flow channel pattern includes at least one flow channel extending from an uphole to a downhole end of the flow channel section.

4. The landing collar of claim 3, wherein the flow channel pattern further includes a ring-shaped portion circumscribed within the body downhole and fluidly connected to the at least one flow channel.

5. The landing collar of claim 2, wherein a longitudinal length of the flow channel section is longer than a longitudinal length of the landing seat.

6. The landing collar of claim 2, wherein the flow channel section is downhole of the landing seat in the unsheared condition of the landing seat, and the landing seat is within the flow channel section in the sheared condition of the landing seat.

7. The landing collar of claim 1, wherein the fluid communication passageway of the landing seat includes at least one notch at a downhole end of the landing seat.

8. The landing collar of claim 7, wherein the fluid communication path includes a ring-shaped portion circumscribed within the body, the at least one notch aligned with the ring-shaped portion in the sheared condition of the landing seat.

9. The landing collar of claim 1, wherein the main flow path of the tubular body from uphole of the landing seat to downhole of the landing seat in the unsheared condition of the landing seat is blocked when the landing seat is in receipt of the liner wiper plug, and the sheared condition of the landing seat fluidically connects the flow path uphole of the landing seat to the fluid communication path between the landing seat and the tubular body.

10. The landing collar of claim 9, wherein the flowpath downhole of the landing seat is fluidically connected to the fluid communication passageway when the landing seat is in the sheared condition.

11. The landing collar of claim 1, further comprising a ball seat assembly having a shearable ball seat installed within the body downhole of the landing seat.

12. The landing collar of claim 11, further comprising a baffle secured within the tubular body, the baffle having a plurality of longitudinal apertures configured to allow fluid communication between uphole and downhole sides of the baffle, the ball seat assembly interposed between the baffle and the landing seat.

13. The landing collar of claim 11, wherein the ball seat assembly further includes a ball seat insert installed within the body and receiving the shearable ball seat therein, the landing seat prohibited from further downhole movement by the ball seat insert in the sheared condition of the landing seat.

14. The landing collar of claim 1, wherein an interior surface of the landing seat includes a frustoconical portion and a plurality of ring-shaped grooves to receive the liner wiper plug therein.

15. A downhole system including the landing collar of claim 1, the downhole system further including:

a liner hanger connected uphole of the landing collar; and, a float collar connected downhole of the landing collar.

16. The downhole system of claim 15 further comprising the liner wiper plug and a pump down plug latched within the liner wiper plug.

17. A method of completing a cemented liner with a wet shoe using the landing collar of claim 1, the method comprising:

landing the liner wiper plug in the shearable liner wiper plug landing seat in the body of the landing collar;

increasing pressure within the landing collar to shear the landing seat; and, establishing fluid communication from uphole the landing seat to downhole the landing seat via the fluid communication path between the landing seat and the body and the fluid communication passageway in the wall of the landing seat.

18. A method of completing a cemented liner with a wet shoe, the method comprising:

landing a liner wiper plug in a shearable liner wiper plug landing seat in a body of a landing collar;

increasing pressure within the landing collar to shear the landing seat; and, after landing the liner wiper plug in the landing seat and shearing the landing seat with the liner wiper plug seated therein, establishing fluid communication from uphole the landing seat to downhole the landing seat via a fluid communication path between the landing seat and the body.

19. The method of claim 18, further comprising pumping completion fluid through the landing collar via the fluid communication path to displace cement from a shoe track.

20. The method of claim 18, further comprising pumping cement through the landing collar prior to landing the liner wiper plug.

21. The method of claim 20, further comprising, prior to pumping cement, dropping a setting ball through the landing seat and onto a ball seat within the landing collar, applying pressure within a string containing the landing collar, setting a liner hanger hydraulically, and applying additional pressure within the string to shear the ball seat and regain circulation through the string.

22. A landing collar comprising:

a tubular body having a longitudinally extending main flow path;

a ball seat assembly having a shearable ball seat installed within the body; and, a shearable liner wiper plug landing seat installed within the body uphole of the ball seat assembly, the landing seat configured to receive a liner wiper plug and block fluid communication through the main flow path from uphole the landing seat to downhole the landing seat when the liner wiper plug is seated therein in an unsheared condition of the landing seat, the landing seat movable in a downhole direction within the body in a sheared condition of the landing seat;

wherein, in the sheared condition of the landing seat with the liner wiper plug seated therein, fluid communication from uphole the landing seat to downhole the landing seat is enabled using a fluid communication path between the landing seat and the body.

* * * * *